US006702556B2

(12) United States Patent
Axelsson

(10) Patent No.: US 6,702,556 B2
(45) Date of Patent: Mar. 9, 2004

(54) MULTI-CYLINDER COMPRESSION PUMP

(75) Inventor: Fredrik Axelsson, Mariestad (SE)

(73) Assignee: FX Airguns AB, Hova (SE)

( * ) Notice: Subject to any disclaimer, the term of this patent is extended or adjusted under 35 U.S.C. 154(b) by 24 days.

(21) Appl. No.: 10/169,868

(22) PCT Filed: Feb. 1, 2001

(86) PCT No.: PCT/SE01/00181

§ 371 (c)(1),
(2), (4) Date: Jul. 10, 2002

(87) PCT Pub. No.: WO01/57400

PCT Pub. Date: Aug. 9, 2001

(65) Prior Publication Data

US 2003/0003006 A1 Jan. 2, 2003

(30) Foreign Application Priority Data

Feb. 7, 2000 (SE) ..... 0000369

(51) Int. Cl.[7] ..... F04B 53/00
(52) U.S. Cl. ..... 417/523; 417/258; 417/468
(58) Field of Search ..... 417/523, 468, 417/469, 525, 534, 258, 259

(56) References Cited

U.S. PATENT DOCUMENTS

| | | | | | |
|---|---|---|---|---|---|
| 817,538 | A | * | 4/1906 | Wixon | 417/258 |
| 1,187,835 | A | * | 6/1916 | Hill et al. | 417/258 |
| 1,351,847 | A | * | 9/1920 | Gerhart | 417/468 |
| 1,424,928 | A | * | 8/1922 | McClelland | 417/258 |
| 1,491,388 | A | * | 4/1924 | Foster | 417/468 |
| 5,779,457 | A | * | 7/1998 | Chuang et al. | 417/468 |
| 5,885,061 | A | * | 3/1999 | Olofsson et al. | 417/258 |
| 6,027,319 | A | * | 2/2000 | Winefordner et al. | 417/468 |
| 6,190,142 | B1 | * | 2/2001 | Wu | 417/523 |
| 6,371,741 | B1 | * | 4/2002 | Wu | 417/468 |

FOREIGN PATENT DOCUMENTS

| | | |
|---|---|---|
| CH | 230829 | 4/1944 |
| FR | 583549 | 1/1925 |
| SE | 463 732 | 1/1991 |
| SE | 503 809 | 9/1996 |

* cited by examiner

*Primary Examiner*—Cheryl J. Tyler
(74) *Attorney, Agent, or Firm*—Burns, Doane, Swecker & Mathis, LLP

(57) ABSTRACT

The invention concerns a pump for compression of gases, such as air, of the type comprising a first cylinder and a second cylinder, a piston dividing said first cylinder into a first chamber located ahead of the piston and a second chamber located behind the piston, the piston and the second cylinder arranged to be displaced jointly relative to the first cylinder. A third chamber is formed between end walls of the cylinders and communicates with said second chamber via at least one opening formed in the jacket wall of the first cylinder. The pump is characterized by an inlet provided in the second end of the second cylinder in order to allow passage of air into a fourth chamber formed between the second end of the second cylinder and the end wall of the first cylinder, said fourth chamber communicating with said third chamber via a through-passage channel, wherein a valve is provided, formed in the end wall of the first cylinder.

4 Claims, 2 Drawing Sheets

MULTI-CYLINDER COMPRESSION PUMP

TECHNICAL FIELD

The present invention relates to an improved pump for compression of gases, such as air, comprising a first, stationary cylinder, wherein a piston is arranged for movement in the longitudinal direction of said cylinder so as to divide the latter into a first chamber located ahead of the piston, and a second chamber located behind the piston, a piston rod securely joining said piston to a second movable cylinder arranged externally of the first cylinder so as to ensure co-ordination of the movements of said piston and said second cylinder. The open end of said second cylinder is sealed against the external face of the first cylinder and the open end of the first cylinder is sealed against the internal wall of the second cylinder, whereby a third chamber is formed between the seals.

TECHNICAL BACKGROUND

Pumps of the above kind are known from SE 463 732 and could be regarded as a two-step pump because the compression of air takes place in two steps, viz. both when the cylinders pushed together and when the are pulled apart. Owing to this double compression feature, this type of pump is quite superior to the conventional bicycle pump when it comes to producing comparatively high pressures by means of comparatively moderate forces. However, when sufficiently high pressures are required, for example in the magnitude of 200 bars, pumps of the kind defined above are not satisfactory either. Pressures of this magnitude are required for instance for high-pressure cartridges for air guns.

SUMMARY OF THE INVENTION

The object of the present invention is to provide a pump of the kind defined in the introduction, which offers an improved degree of compression by means of substantially unchanged forces.

The compression of air thus is effected in three steps. The first step takes place, when the air in the fourth chamber is forced into the second and third chambers. Since the goods in the first cylinder occupies some of the space between the second and third chambers, the total cross-sectional area of these chambers is inferior to the cross-sectional area of the fourth chamber, and consequently compression of the air takes place.

The second step is effected when the air is forced from the second and third chambers into the first chamber. The latter chamber has a considerable smaller cross-sectional area than the first-mentioned ones, since it is limited by the first, smallest cylinder. Consequently, the Air is Compressed Further in this Step.

The third step takes places exactly like in the above two-step pump, when the air in the second chamber is forced out through the outlet formed in the first end of the first cylinder.

The through-passage valve in the second cylinder inlet could be made adjustable to allow adjustment of the flow through the inlet. By throttling the inflow, the pumping movements consume less power because less air is introduced into the pump and consequently less compression work is done. If said through-passage valve is throttled, a predetermined negative pressure is created in the fourth chamber when the pumping house is extended in the course of the upwardly directed pumping movement.

Obviously, other gases than air could be compressed by means of the pump in accordance with the invention.

In accordance with a preferred embodiment a third cylinder, which is fixedly interconnected with the first cylinder surrounds the second cylinder. This third cylinder has sealing contact with the end wall of the second cylinder, whereby a fifth chamber is formed between said end wall and one end of the third cylinder. This fifth chamber communicates with said third chamber via a first through-passage valve and with the environment via a second through-passage valve.

In this case, when the second cylinder and the piston rod are moved away from the first cylinder, the pump is arranged to draw air past said second through-passage valve into the fifth chamber and in doing so close said first through-passage valve, and to force air from the fifth chamber past said first through-passage valve into the third chamber, and in doing so close said second through-passage valve.

In accordance with this embodiment, a three-step pump with double compression in the first step is provided. As described above, air passing from the fourth chamber to the second and third chambers is compressed, as is also air passing from the fifth chamber to said second and third chambers.

Since the two compression operations take place simultaneously, a considerable improvement of the total compression is achieved.

BRIEF DESCRIPTION OF THE DRAWINGS

The present invention will be described in more detail in the following with reference to the accompanying drawings which illustrate a preferred embodiment of the invention and wherein.

DETAILED DESCRIPTION OF A PREFERRED EMBODIMENT

Figure 1:
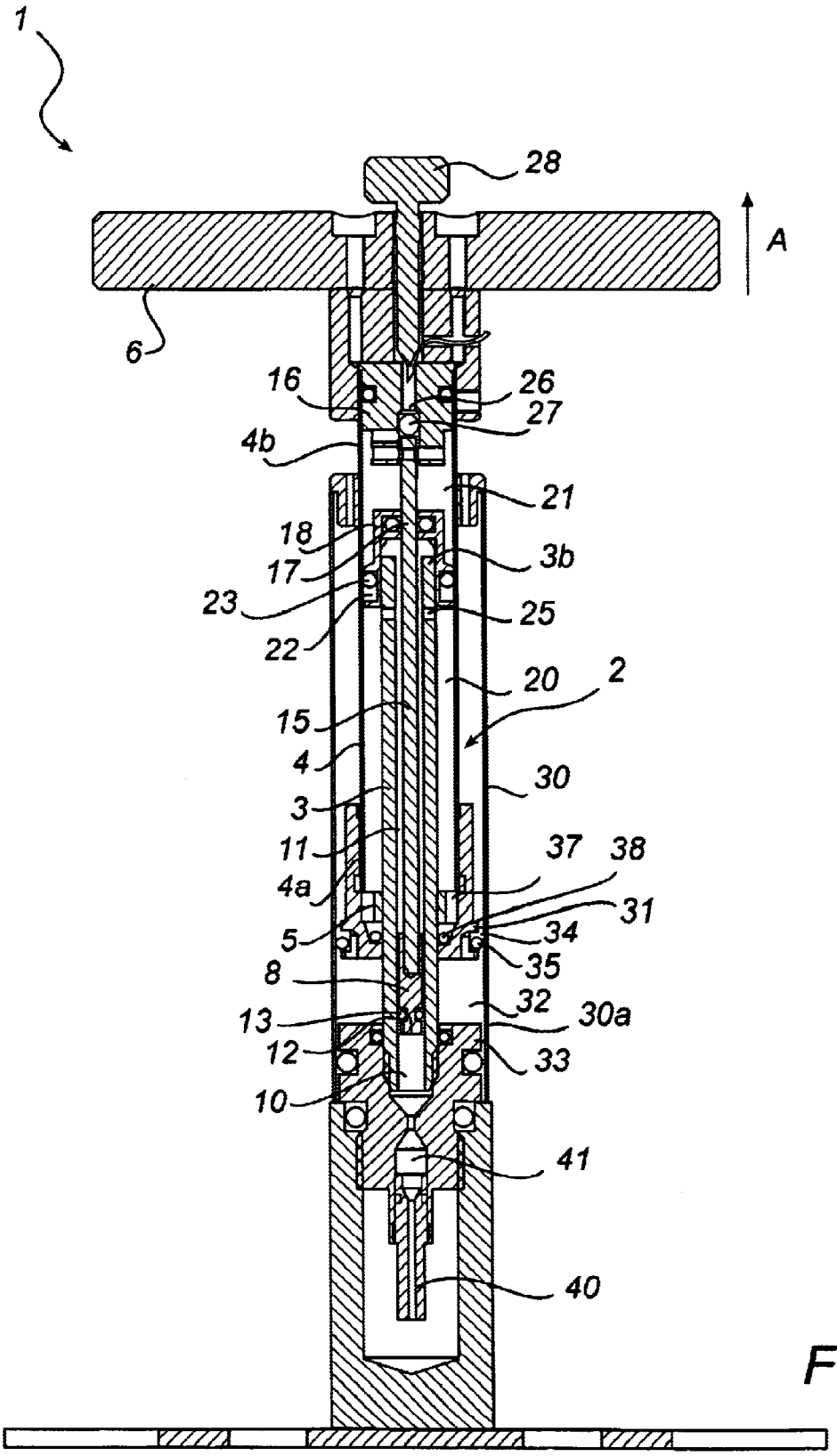
FIG. 1 is a cross-sectional view of a pump in accordance with one embodiment of the present invention in a first, nearly completely pushed together (contracted) position.
Figure 2:
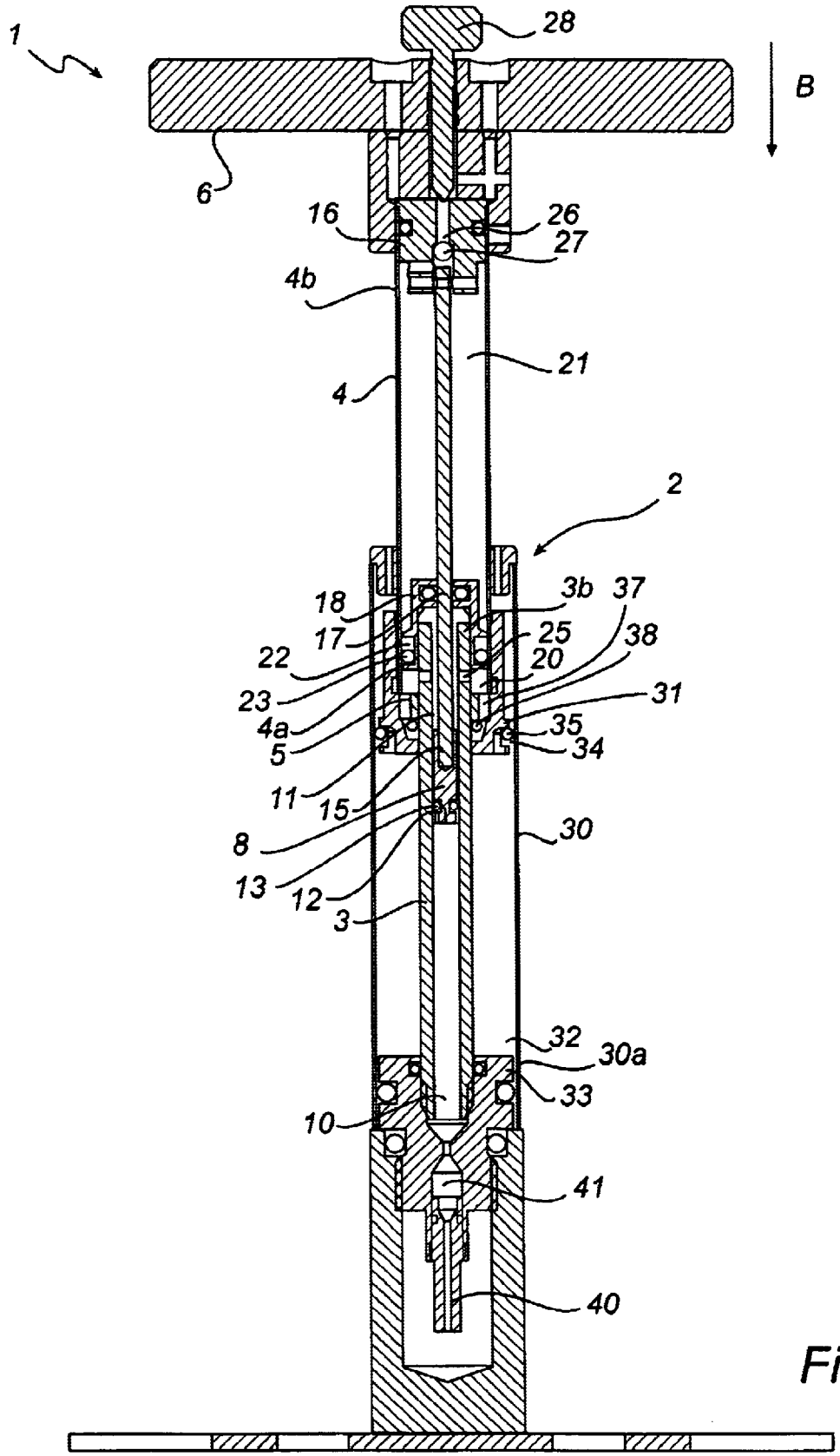
FIG. 2 shows the pump of FIG. 1 in a second, nearly completely pulled apart (expanded) position.

The pump illustrated in FIGS. 1–2 comprises a pump housing 2 consisting of a first, stationary cylinder 3 and a second, movable cylinder 4 surrounding the first cylinder and arranged to move to and from in the lengthwise direction of the first cylinder. The lower end 4*a* of the movable cylinder 4 is formed with an annular end wall 5 in tightly sealed contact with the external face of the first cylinder 3. At the upper end 4*b* of the second cylinder 4 an operating handle 6 is provided, making it more convenient for the user to effect pumping movements of the cylinders 3, 4 relative to one another.

The stationary cylinder 3 houses a piston 8 dividing the cylinder 3 into a first lower chamber 10 located ahead of the piston and a second upper chamber 11 located behind the piston. The chambers 10 and 11 communicate via a through-passage channel 12 formed in the piston 8 and formed with a through-passage valve 13, such as an O-ring allowing air passage only from the upper chamber 11 to the lower one 10.

The lower chamber 10 debouches into an outlet channel 40 in which a valve means 41 is mounted.

The piston 8 is fixedly secured to a piston rod 15, which in turn is fixedly secured to a cylinder-end closing wall 16 at the upper end 4*b* of the second cylinder 4, ensuring coordinated the movements of the cylinder 4 and of the piston 8 relative to the cylinder 3. The piston rod 15 extends through a recess 17 formed in an end wall 18 arranged at the upper end 3*b* of the first cylinder 3.

The end wall 18 is in tightly sealed contact with the internal face of the second cylinder 4 and thus it forms a partition wall 18, dividing the cylinder into a third chamber 20 located below the partition wall and a fourth chamber 21 located above the partition wall. The chambers 20, 21 communicate via a through-passage channel 22 formed in the partition wall 18, in which channel a through-passage valve 23 is located, such as an O-ring allowing air passage only from the upper chamber 21 to the lower one 20.

In addition, the third chamber 20 communicates with the second chamber 11 via one or several apertures 25 formed in the casing wall of the first cylinder 3. These apertures 25 ensure that an equal pressure P is maintained in the second and third chambers at all times.

At the upper end 4*b* of the second cylinder 4 an inlet channel 26 is formed, wherein a through-passage valve 27, such as a ball valve, is provided, allowing passage of air into the upper chamber 21 of the cylinder 4. The valve 27 is provided with a means 28 for regulating the flow through the inlet channel.

The inlet channel 26 could be a bore extending through the cylinder-end closing wall 16, and a setscrew could be provided in the bore to allow regulation of the flow.

In accordance with the preferred embodiment shown in the drawing figures, a third cylinder 30, which is fixedly secured to the first cylinder, surrounds the second cylinder.

Another annular end wall 31 is arranged at the lower end 4*a* of the second cylinder 4 so as to project radially outwards from the cylinder wall. The end wall 31 is in tightly sealed contact with the internal face of the third cylinder 30, whereby a fifth chamber 32 is formed intermediate the end wall 31 and a cylinder-end closing wall 33 at the lower end 30*a* of the cylinder 30. A second inlet channel 34 is formed in the end wall 31, said channel being provided with an inlet valve 35 allowing passage of air only into chamber 32. Chamber 32 further communicates with the lower chamber 20 of the second cylinder 4 via a through-passage channel 37 formed in the end wall 5, said channel housing a through-passage valve 38, such as an O-ring allowing passage of air only from the fifth chamber 32 to the third chamber 20.

In the shown example, all three cylinders 3, 4, 30 are arranged in concentric relationship, nesting one in the other. Preferably, they have a circular cross-sectional area but other cross-sectional shapes such as hexagonal or square are not inconceivable. The cylinders 3, 4, 30 could be made e.g. from stainless steel or some other similar material.

The end walls 5, 18, 31 could be made from e.g. some plastics material and could be attached to the respective cylinder by means of a threaded joint or by gluing or the like. The end walls 5 and 31 could also be formed from one single annular element, should such a configuration be preferred.

The function of the pump will be described in the following.

When the pump housing 2 is pulled apart, the second cylinder 4, the piston rod 15 and the piston 8 are moved in the direction indicated by A away from the first and third cylinders 3, 30 (see FIG. 1). Because of this movement the distance between the end wall 5 and the cylinder-end closing wall 16 of the cylinder 4 increases, and consequently the volume of the fourth chamber 21 increases. Air is therefore drawn from the surroundings into the inlet 26 in the cylinder-end closing wall 16, past, the through-passage valve 27, and fills the chamber 21. Simultaneously, through-passage valve 23 closes, thus preventing air from passing upwards from the third chamber 20 to the fourth one 21.

In a corresponding manner, the distance between end wall 31 and the cylinder-end closing wall 33 of the third cylinder 30 increases, whereby the volume of the fifth chamber 32 increases. Surrounding air thus is drawn through the channel 34 formed in the end wall 31, past the valve 35, and fills chamber 32. At the same time, the through-passage valve 37 closes, preventing air from passing downwards from the third chamber 20 to the fifth chamber 32.

The movement also reduces the distance between the end walls 5 and 18 as well as between the end wall 18 and the piston 8, thus reducing the volumes of the third and the second chambers 20 and 11, respectively. At the same time, the volume of the first chamber 10 increases. The air in the second and third chambers 11 and 20 that communicate via apertures 25, cannot, as indicated above, pass the valves 23 and 37 and is instead forced to pass through channel 12, past valve 13 and downwards into the first, expanding chamber 10.

It is worth noting that the first chamber 10 has a cross-sectional area smaller than the sum of the cross-sectional areas of the second and third chambers 11, 20. As the air from the second and third chambers is being forced downwards into the first chamber, it is therefore compressed at the same time.

When the pump housing is pushed together, the second cylinder 4, the piston rod 15 and the piston 8 are moved in direction B towards the first and third cylinders 3, 30 (see FIG. 2). This movement reduces the distance between the cylinder-end closing wall 16 and the end wall 18, whereby the volume of the fourth chamber 21 is diminished. The valve 27 in the inlet 26 prevents air from leaving the chamber 21 via the inlet, and instead the air is forced through the channel 22, past the valve 23 down into chamber 20. It is worth noting that the fourth chamber 21 has a cross-sectional area superior to the total cross-sectional areas of the second and third chambers 11, 20, because the first cylinder 3, forming a partition wall between the chambers 11 and 20, occupies part of the cross-sectional area. The air is therefore compressed upon its passage from the fourth chamber 21, the volume of which diminishes upon this movement, to the second and third chambers 11, 20, the volumes of which, although increasing as a result of this movement, do not increase at the same pace.

In a corresponding manner, the distance between the end wall 31 and the cylinder-end closing wall 33 is reduced, the volume of the fifth chamber 32 thereby diminishing. The valve 35 in the inlet 34 prevents air from leaving the chamber 32 via the inlet 34 and instead the air is forced upwards through the channel 37 formed in the end wall 5, past the valve 38, and enters chamber 20. It is worth noting that the fifth chamber 32 has a cross-sectional area superior to the sum of the cross-sectional areas of the second and third chambers 11, 20, since the third cylinder 30 is larger than the second cylinder 4. Thus, the air that is forced from the fifth chamber 32 to the-second and third chambers 11, 20 is compressed.

The movement also causes the piston 8 to move further downwards inside the first cylinder 3, whereby the volume of the first chamber 10 is reduced, and the air contained therein is subjected to a pressure increase until the valve 41 is opened, letting the air leave through the outlet 40.

It should be understood that the present invention is not limited to the embodiments described above but that on the contrary, it encompasses all varieties that are within the scope of protection of the appended claims.

What is claimed is:

1. A pump (1) for compression of gases, such as air, comprising a first cylinder (3) provided in a first end (3*a*) with an outlet (40) and in a second end (3*b*) with an end wall (18), a second cylinder (4) arranged around the first cylinder (3) for displacement to and fro and provided in a first end (4*a*) with an end wall (5), a piston (8) arranged in said first cylinder (3) for displacement to and fro and dividing the cylinder into a first chamber (10) located ahead of the piston and a second chamber (11) located behind the piston, said second chamber communicating with said first chamber via a through-passage channel (12) formed in said piston (8) and provided with a valve (13), and a piston rod (15) securely joined to the piston (8) and extending through the end wall (18) of said first cylinder and being securely joined to the second cylinder (4) in a manner ensuring that the piston (8) and the second cylinder (4) are displaceable jointly to and fro relative to the first cylinder (3), the end wall (18) of the first cylinder (3) being in sealed contact with the internal face of the second cylinder (4) and the end wall (5) of the second cylinder (4) being in sealed contact with the external face of the first cylinder (3), such that a third chamber (20) is formed between said end walls (5, 18), said third chamber communicating with said second chamber (11) via at least one opening (25) in the jacket wall of the first cylinder, characterised in that an inlet (26) provided with a valve (27) is provided in the second end (4*b*) of the second cylinder (4) in order to allow passage of air into a fourth chamber (21) formed between the second end (4*b*) of the second cylinder (4) and the end wall (18) of the first cylinder (3), said fourth chamber (21) communicating with said third chamber (20) via a through-passage channel (22), wherein a valve (23) is provided, formed in the end wall (18) of the first cylinder, said pump arranged, upon the second cylinder (4) and the piston (8) being moved away from the first cylinder (3), to close the valve (23) formed in the end wall (18) of the first cylinder (3) and to force air contained in said third chamber (20) through said opening (25) in the jacket wall of said second cylinder (4) into said second chamber (11), and further past the valve (13) in the piston (8) into the first chamber (10) while simultaneously drawing air through the inlet (26) into the fourth chamber (21), and, upon the second cylinder (4) and the piston (8) being displaced towards the first cylinder (3), to close the valve (13) in the piston (8) and to force air from said fourth chamber (21) past the valve (23) in the end wall (18) of the first cylinder (3) into the third chamber (20), and further through the opening (25) in the second chamber (11) while at the same time expelling the air contained in the first chamber (10) out through the outlet (40) of the first cylinder (3).

2. A pump as claimed in claim 1, wherein said valve (27, 28) provided in the inlet (26) of the second cylinder is arranged to be adjustable for regulation of the flow through the inlet (26).

3. A pump as claimed in claim 2, further comprising a third cylinder (30) fixedly interconnected with the first cylinder and surrounding the second cylinder (4), said third cylinder having sealing contact with the end wall (5, 31) of the second cylinder, whereby a fifth chamber (32) is formed between said end wall (5, 31) and one end (30*a*) of the third cylinder, said chamber (32) communicating with said third chamber (20) via a through-passage channel (37) formed with a first valve (38) and with the environment via a second through-passage (34) formed with a second valve (35), said pump also arranged, upon displacement of the second cylinder (4) and the piston (8) away from the first cylinder (3), to close said first valve (38) and to draw air past said second valve (35) into the fifth chamber (32), and upon displacement of said second cylinder (4) and the piston (8) towards the first cylinder (3), to so close said second valve (35) and to force air from the fifth chamber (32) past said first valve (38) into the third chamber (20).

4. A pump as claimed in claim 1, further comprising a third cylinder (30) fixedly interconnected with the first cylinder and surrounding the second cylinder (4), said third cylinder having sealing contact with the end wall (5, 31) of the second cylinder, whereby a fifth chamber (32) is formed between said end wall (5, 31) and one end (30*a*) of the third cylinder, said chamber (32) communicating with said third chamber (20) via a through-passage channel (37) formed with a first valve (38) and with the environment via a second through-passage (34) formed with a second valve (35), said pump also arranged, upon displacement of the second cylinder (4) and the piston (8) away from the first cylinder (3), to close said first valve (38) and to draw air past said second valve (35) into the fifth chamber (32), and upon displacement of said second cylinder (4) and the piston (8) towards the first cylinder (3), to so close said second valve (35) and to force air from the fifth chamber (32) past said first valve (38) into the third chamber (20).

* * * * *